United States Patent [19]

Holloway et al.

[11] Patent Number: 4,665,958

[45] Date of Patent: May 19, 1987

[54] FUNNEL DEVICE FOR DRAINING LIQUIDS

[75] Inventors: Eugene L. Holloway; Alvin C. Boyer, both of Modesto, Calif.

[73] Assignee: Shell Oil Company, Houston, Tex.

[21] Appl. No.: 739,412

[22] Filed: May 30, 1985

[51] Int. Cl.[4] ..... B67C 9/00

[52] U.S. Cl. ..... 141/106; 250/434

[58] Field of Search ..... 141/106, 319, 332, 364; 248/94, 311.3, 312.1; 250/431, 434, 507.1

[56] References Cited

U.S. PATENT DOCUMENTS

| | | | |
|---|---|---|---|
| 118,051 | 8/1871 | Price | 141/98 |
| 478,303 | 7/1892 | Allgood | 141/106 |
| 2,545,293 | 3/1951 | McGeady | 141/106 X |
| 2,774,393 | 12/1956 | Swan | 141/364 X |
| 2,851,064 | 9/1958 | McCowan | 141/106 X |
| 2,899,079 | 8/1959 | Davis | 248/311.3 X |
| 2,939,593 | 4/1958 | Kelley | 141/106 X |
| 3,156,270 | 11/1964 | Erickson | 141/106 |
| 3,939,998 | 2/1976 | Soltermann | 141/332 X |
| 4,357,541 | 11/1982 | Ernst | 250/507.1 |

FOREIGN PATENT DOCUMENTS

| | | | |
|---|---|---|---|
| 365492 | 8/1931 | United Kingdom | 141/364 |

*Primary Examiner*—Stephen Marcus
*Assistant Examiner*—Mark Thronson

[57] ABSTRACT

A funnel device is provided for emptying liquid from scintillation vials and disposing of the empty vials. The device has a top provided with rows of holes to loosely accommodate standard liquid scintillation vials. Beneath each row of holes is a rod. The vials are placed, inverted, through the holes to rest on the rod beneath. After the vials have drained into an appropriate container, the device is moved to rest on a vial collection container, and the rods are removed, allowing the vials to fall into the collection container.

3 Claims, 3 Drawing Figures

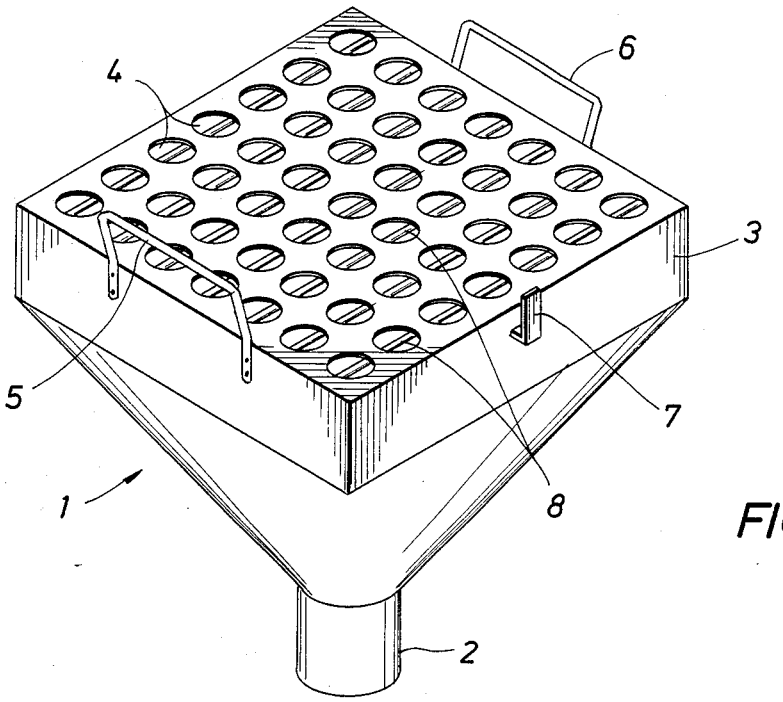
FIG. 1
FIG. 2
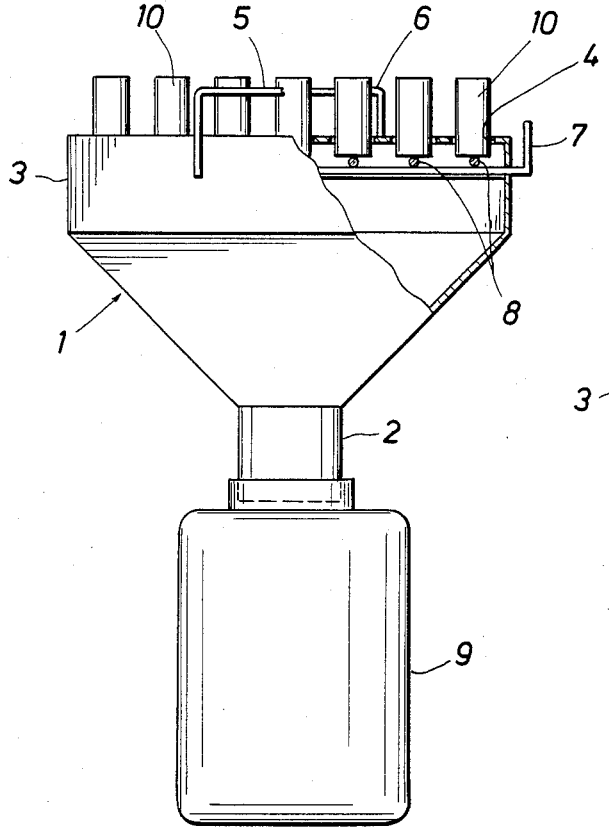
FIG. 3
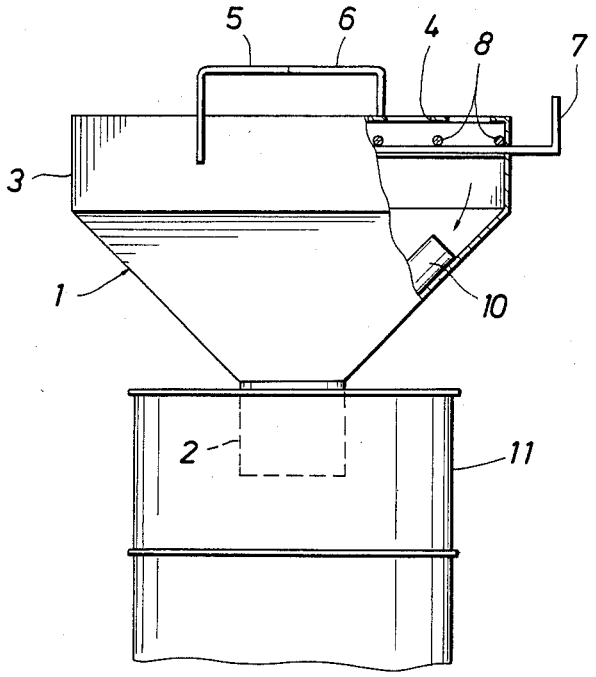

FUNNEL DEVICE FOR DRAINING LIQUIDS

BACKGROUND OF THE INVENTION

Regulations at radioactive waste dump sites have moved toward elimination of permits to dump radioactive waste in a liquid form. Many dumping sites now require solidifying all liquid radioactive waste by mixing the liquid waste with an absorbent material. Large numbers of scintillaton vials full of samples of radioactive waste, usually liquids, accumulate after the testing thereof. Conventionally, such vials and their contents have been stored in waste dump sites. Now, however, the vials must first be emptied and supplied for disposal separately from their contents. In view of the large numbers of liquid scintillation vials involved, this is a considerable undertaking, and also a significant risk for the operator of radioactive contamination.

Applicant is not aware of any prior art which, in his judgment, would anticipate or render obvious the novel apparatus of the present invention; however, for purposes of fully developing the background of the invention, and establishing the state of the requisite art, the following is set forth. U.S. Pat. No. 3,939,998 is of relevance for its disclosure of a device receiving vials, draining the contents thereof into a first receptacle and discharging the vials into a second receptacle. Funnels with provisions for holding containers for drainage are shown in U.S. Pat. Nos. 118,051, 478,303, and 2,939,593.

SUMMARY OF THE INVENTION

The primary purpose of the present invention is to provide an apparatus for emptying liquid from scintillation vials and disposing of the empty vials, which apparatus is economical in use, and which does not subject the operator to risk of radioactive contamination. Accordingly, the present invention provides apparatus for emptying liquid from scintillation vials and disposing of the empty vials, comprising a funnel with a cover having holes to receive the scintillation vials in an inverted position; means beneath the holes to prevent the scintillation vials from falling through the cover; means to receive liquid falling from the vials through the funnel; means to remove the means preventing the vials from falling through the holes in the cover; and means to receive the vials falling from the cover through the funnel. Preferably, the vials are arranged in several rows and the means preventing the vials from falling through the holes is a removable frame of metal rods beneath the holes.

Other purposes, distinctions over the art, advantages and features of the invention will be apparent to one skilled in the art upon review of the following.

BRIEF DESCRIPTION OF THE DRAWINGS

FIG. 1 discloses the funnel device of the invention.

FIG. 2 discloses the funnel device of FIG. 1 arranged over a container for receiving radioactive fluid and having scintillation vials disposed in the funnel device.

FIG. 3 discloses the funnel device of FIG. 1 after the scintillation vials shown in FIG. 2 have fallen into a container beneath the funnel device.

DESCRIPTION OF PREFERRED EMBODIMENTS

Referring now to FIGS. 1 through 3 of the drawings, there is shown in FIG. 1 the basic funnel device of the present invention wherein a funnel having an upper portion 1 preferably of an inverted pyramidal shape, terminating in a round portion 2. The round portion of the funnel is, for example, about 3¾-inches in diameter and is about 2-inches long. Above the pyramidal portion 4 of the funnel there is a cover 3 which preferably is square in shape and, for example, 10 to 12 inches in width. Within the cover 3 there is provided a series of holes 4 which may be the same or of varying sizes and which are adapted to receive scintillation vials. In a preferred embodiment seven rows of seven holes are provided which are about 1-3/16ths-inch in diameter. On either side of the cover 4 are located handles 5 and 6 which are adaptable to moving the device from one location to another as will be more particularly described hereinafter. Across from handles 5 and 6 there is provided a lever 7 which is connected to a series of rods 8 which pass beneath the holes 4.

Referring now to FIG. 2 of the invention, the funnel device is positioned above a container 9 which is adapted to receive liquid falling from the scintillation vials 10 which are now located in the holes 4 of the cover to the funnel device. The scintillation vials are allowed to remain in this position, for a sufficient period of time to enable substantially complete removal of the liquid from the vials.

In FIG. 3 there is shown the funnel device arranged over a container 11 for receiving the empty vials 10 after the handle 7 has been moved to one side so that rods 8 beneath the vials are moved to one side, thereby releasing the vials to pass downwardly into the collection container 11.

The foregoing description of the invention is merely intended to be explanatory thereof, and various changes in the details of the described apparatus may be made within the scope of the appended claims without departing from the spirit of the invention.

What is claimed is:

1. Apparatus for emptying liquid from scintillation vials and disposing of the empty vials, comprising:

a funnel with a cover having rows of holes to receive the scintillation vials in an inverted position;

means beneath the holes to prevent the scintillation vials from falling through the cover comprising parallel laterally extending rods, each rod being beneath a row of holes;

means to receive liquid falling from the vials through the funnel;

means to remove the means preventing the vials from falling through the cover comprising a lever connecting with each rod and operative to simultaneously move each rod to one side of a respective row of holes; and means to receive the vials falling through the cover.

2. The apparatus of claim 1 wherein the cover is approximately square and a lower portion of the funnel is round.

3. The apparatus of claim 2 wherein the vials contain radioactive waste.

* * * * *